US009396839B2

(12) United States Patent
Sultan et al.

(10) Patent No.: US 9,396,839 B2
(45) Date of Patent: Jul. 19, 2016

(54) CABLE WITH IMPROVED FLAME RETARDANCY

(75) Inventors: Bernt-Ake Sultan, Stenungsund (SE); James Elliott Robinson, Genval (BE); Wendy Loyens, Stenungsund (SE); Susanna Lieber, Melle (DE)

(73) Assignee: Borealis Technology OY, Porvoo (FI)

( * ) Notice: Subject to any disclaimer, the term of this patent is extended or adjusted under 35 U.S.C. 154(b) by 685 days.

(21) Appl. No.: 12/525,517

(22) PCT Filed: Jan. 29, 2008

(86) PCT No.: PCT/EP2008/000683
§ 371 (c)(1),
(2), (4) Date: Sep. 24, 2009

(87) PCT Pub. No.: WO2008/092642
PCT Pub. Date: Aug. 7, 2008

(65) Prior Publication Data

US 2010/0108354 A1 May 6, 2010

(30) Foreign Application Priority Data

Feb. 1, 2007 (EP) ..... 07002225

(51) Int. Cl.
*H01B 11/04* (2006.01)
*H01B 7/295* (2006.01)
*H01B 3/30* (2006.01)

(52) U.S. Cl.
CPC . *H01B 7/295* (2013.01); *H01B 3/30* (2013.01)

(58) Field of Classification Search
CPC ..... H01B 3/00; H01B 11/04; H01B 7/0208
USPC ..... 174/110 R, 113 R, 120 R, 121 A
See application file for complete search history.

(56) References Cited

U.S. PATENT DOCUMENTS

| | | | | |
|---|---|---|---|---|
| 4,769,179 | A * | 9/1988 | Kato et al. | 252/609 |
| 6,495,760 | B1 * | 12/2002 | Castellani et al. | 174/110 R |
| 7,015,398 | B2 * | 3/2006 | Vexler | H01B 7/295 174/120 R |
| 8,097,809 | B2 * | 1/2012 | Galletti et al. | 174/110 R |
| 2008/0105454 | A1 * | 5/2008 | Morioka et al. | 174/120 SR |
| 2008/0188604 | A1 * | 8/2008 | Cogen et al. | 524/425 |
| 2008/0251273 | A1 * | 10/2008 | Brown | H01B 7/295 174/113 R |
| 2009/0030130 | A1 | 1/2009 | Yasumoto | |
| 2010/0051315 | A1 * | 3/2010 | Galletti et al. | 174/110 R |

FOREIGN PATENT DOCUMENTS

| | | | |
|---|---|---|---|
| EP | 0017002 | A1 | 10/1980 |
| EP | 1396865 | * | 3/2004 |
| GB | 216317 | A | 2/1986 |
| WO | WO 2005/013291 | * | 10/2005 |
| WO | 2006123530 | | 11/2006 |

OTHER PUBLICATIONS

EP Search Report, EP, Jul. 30, 2007.

* cited by examiner

*Primary Examiner* — Chau N Nguyen
(74) *Attorney, Agent, or Firm* — Milbank, Tweed, Hadley & McCloy LLP

(57) ABSTRACT

The present invention relates to a cable comprising one or more insulated conductors which are embedded in a bedding composition having improved flame retardancy. The bedding composition comprises a resin (A) and inorganic filler (B), which is a hydroxide or hydrated compound.

12 Claims, No Drawings

CABLE WITH IMPROVED FLAME RETARDANCY

This application is based on International Application PCT/EP2008/000683 filed Jan. 29, 2008, which claims priority to European Patent Application No. 07002225.6, filed on Feb. 1, 2007, the disclosures of which are incorporated by reference herein in their entireties.

The present invention relates to a cable comprising one or more insulated conductors which are embedded in a bedding composition having improved flame retardancy.

A typical electric power cable generally comprises one or more conductors in a cable core, which is optionally surrounded by several layers of polymeric materials. In particular, the construction of electric power cables for low voltage, i.e. voltage of below 6 kW, or control, computer and telecommunication cables usually comprises an electric conductor which is scouted with an insulation layer of polymeric material. Optionally, on ore more of such insulated conductors are surrounded by a common outer sheath layer, the jacket.

In general, for cables and wires used in constructions like buildings, industries, vehicles, ships, tunnels etc. flame resistance is required. However, the polymers, especially polyolefins, which are used in the cables and wires, are inherently combustible materials. Thus, to obtain polymers with improved flame resistance flame retardant additives are incorporated into the polymer, such as halogen based chemicals.

However, there is always a risk that polymeric materials, even though formulated for enhanced flame retardance, will burn if pre-heated to high temperature by an external source, such as an external fire, with the risk that since PVC and/or other halogen-containing materials are used toxic, and corrosive fumes, such as hydrogen chloride gas and/or hydrochloric acid topples are produced.

In the past there are many attempts to provide polymers and flame retardant additives which are halogen free. In general, these flame retardant compositions, which are used as flame retardant layers, include relatively large amounts, typically 50 to 60 wt/% of an inorganic filler such as e.g. hydrated and hydroxide compounds, which during burning decompose endothermically and deliberate intern gases at temperatures in a range of 200 to 600° C. Such inorganic fillers, e.g. include $Al(OH)_3$ or $Mg(OH)_2$. However, these flame retardant materials suffer from the high cost of inorganic fillers and the deterioration of the processability and mechanical properties of the polymer composition due to the high amount of filler.

Therefore, object of the present invention was to avoid the above mentioned disadvantages of the prior art materials and thus to provide a cable having low production costs and which shows an improved balance of flame retardancy, processability as well as mechanical properties.

The present invention based on the finding that the above mentioned object can be achieved, if the cable comprises a bedding composition having improved flame resistance.

Therefore, the present invention provides a cable comprising one or more insulated conductors which are embedded in a bedding composition which comprises a) a resin (A) and b) inorganic filler (B)

wherein the inorganic filler (B) is a hydroxide or hydrated compound.

As demonstrated below, the bedding composition as well as the inventive cable show improved flame retardancy, good fire growth and heat release rates in the $FIPC_{20}$ Scenario 1 test, beside good processability and mechanical properties.

In the present invention the conductors are surrounded by a thermoplastic or crosslinked insulated layer. Any suitable material known in the art can be used for the production of such insulation e.g. polypropylene, polyethylene thermoplastic or crosslinked by the use of silanes, peroxides or irradiation. The insulation might also contain flame retardants, preferably non halogen containing systems like e.g. hydroxides or mineral, silicon rubber combinations as it is described in e.g. EP393959 Most commonly the insulation layer is silane crosslinked, as it is described for example in U.S. Pat. Nos. 4,413,066; 4,297,310; 4,351,876; 4,397,981; 4,446,283; and 4,456,704.

The conductors used in the present invention preferably are conductors of copper or aluminium.

One or more of these insulated conductors are embedded in a bedding composition. In addition to its flame resistance, the bedding composition of the present invention helps to make the cable round. In contrast to common compact bedding layers, the bedding composition of the present invention is acting as an effective flame barrier especially when used in combination with sheaths based on polyolefin, silicon gun and non-hydrate mineral fillers.

Furthermore, the bedding composition does not stick to either the insulation layer of the conductors or to the outer sheath layer of the cable and has a low tear resistance, good extrusion performance.

It is preferred (British Standard 6724) that the bedding composition has a tensile strength strength of not less than 4 $N/mm^2$ and elongation of break not less than 50%, It shall be possible to remove the bedding without damaging the insulation of the core(s). In the present invention, the bedding composition of the cable comprises a resin (A).

The term "resin" is intended to denote all organic polymeric components of the composition. Suitable organic polymeric components for forming the resin (A) include polyolefins, polyesters, polyethers and polyurethanes.

Elastomeric polymers may also be used as for example, ethylene/propylene rubber (EPR), ethylene-propylene-diene monomer rubber (EPDN), thermoplastic elastomer (TPE) and acrylonitrile rubber (NBR).

Silane-crosslinkable polymers may also be used, i.e. polymers prepared using unsaturated silane monomers having hydrolysable groups capable of cross-linking by hydrolysis and condensation to form silanol groups in the presence of water and, optionally, a silanol condensation catalyst.

Furthermore, low molecular components like waxes, parafinic oils, stearates etc. might be added to the above mentioned composition, in order to improve processability. However, it is more preferred to renounce these materials, as they have a negative impact on the flame retardant properties.

In a preferred embodiment the resin (A) is formed by olefin homo- or copolymers. These are, for example, homo- or copolymers of ethylene, propylene, alpha-olefins and polymers of butadiene or isoprene. Suitable homo- and copolymers of ethylene include low density polyethylene, linear low, medium or high density polyethylene and very low density polyethylene.

In a further preferred embodiment of the invention the resin (A) comprises polar polymers having polar groups selected from acrylic acid, methacrylic acid, acrylates, methacrylates, acrylonitrile, acetates or vinyl actetates and the like.

It is also preferred that the polar polymer makes up an amount of 30 parts by weight (pbw) or more, more preferred of 50 pbw or more, and still more preferred of 70 pbw or more, per 100 pbw of the polymeric base resin (A).

The polyolefin composition can be produced by any conventional polymerization process.

Preferably, resin (A) is produced by radical polymerization such as high pressure radical polymerization. High pressure polymerization can be effected in a tubular reactor or an autoclave reactor. Preferably, it is a tubular reactor. In general, the pressure can be within a range of 1200 to 3500 bars and the temperature can be within a range of 150° C. to 350° C. However, the polyolefin can also be prepared by other types of polymerization, such as coordination polymerization, e.g. in a low pressure process, with Ziegler-Natta, chromium, single site/dual site, metallocene (for example transition metals), non-metallocene (for example late transition metals) catalysts. The transition and late transition metal compounds are found in groups 3 to 10 of the Periodic Table (IUPAC 1989). These catalysts can be used in the supported and non-supported mode, i.e. with and without carrier.

The polar copolymers are preferably produced by copolymerisation of olefin monomers, preferably ethylene, propylene or butene, with polar monomers comprising $C_1$- to $C_{20}$ atoms. However, it may also be produced by grafting a polyolefin with the polar groups. Grafting is e.g. described in U.S. Pat. No. 3,646,155 and U.S. Pat. No. 4,117,195.

In the present invention it is further preferred that resin (A) is essentially formed by a blend of at least two different polymers as described above. In this context the term "essentially" means that 90% or more of the resin (A) is formed by such a blend. The blend can be produced by any method known in the art.

The preferred used amount of the resin (A) in the bedding composition is at least 5.0 wt %, more preferred at least 10 wt %, even more preferred at least 15 wt %. The upper limit of the used amount of resin (A) preferably is 60 wt %, more preferably 30 wt %, most preferably 20 wt %, based on the total bedding composition.

The inorganic filler (B) of the bedding composition is a hydroxide or hydrated compound. Preferably the inorganic filler (B) is a hydroxide or hydrate compound of metal of group II or III of the Periodic System of the Elements. More preferably, the inorganic filler (B) is a hydroxide. However, it is more preferred that the inorganic filler (B) of the bedding composition is aluminiumtrihydroxide (ATH), magnesiumhydroxide or boehmite. Aliminiumhydroxide is most preferred.

The inorganic filler (B) of the bedding composition preferably is used in an amount of from 10 to 90 wt %, more preferably of from 10 to 75 wt %, even more preferably of from 15 to 60 wt %, and most preferably of from 20 to 55 wt %, based on the total bedding composition.

The bedding composition of the inventive cable may further comprise an inorganic compound (C) which is neither a hydroxide or a hydrated compound. The inorganic compound (C) preferably is an inorganic carbonate, more preferably a carbonate of metal of group II of the Periodic System of the Elements, aluminium, zinc and/or a mixture thereof, and most preferably calcium carbonate or magnesium carbonate.

The preferred used amount of inorganic compound (C) is from 10 wt % to 55 wt %, more preferably from 15 to 50 wt %, most preferably from 20 to 45 wt %, based on the total bedding composition.

It is preferred that the ratio of inorganic filler (B) divided with inorganic compound (C) is 0.2 to 5, more preferred 0.4 to 2.0.

Furthermore, it is preferred that if the inorganic compound (C) is present, the total amount of inorganic filler (B) and inorganic compound (C) is from 40 to 90 wt %, more preferred from 50 to 85 wt %, most preferred 60 to 80 wt %, based on the total bedding composition.

One measured value which indicates the flame resistance of a composition is the limited oxygen index (LOI).

The LOI test method is performed according to ISO 4589-A-IV. To determine the LOI value of the tested compound, a specimen of the compound is ignited in an atmosphere of a mixture of nitrogen and oxygen. A content of oxygen in $N_2/O_2$ mixture is gradually decreased until the specimen stops burning. The percentage of $O_2$ in that $N_2/O_2$ mixture constitutes the compound LOI value. A high LOI value means that a high percentage of oxygen is needed to sustain combustion, i.e. the compound has good flame resistance.

The limiting oxygen index (LOI) of the bedding composition of the present invention preferably is at least 25, more preferably at least 30 even more preferably at least 35.

It is also preferred that the cable of the present invention comprises a flame retardant sheath layer. The flame retardant sheath layer is used as a jacketing layer, which surrounds the insulated conductors embedded in the above described bedding composition.

The flame retardant sheath layer can be made of any suitable flame retardant composition known in the art. Such flame retardant polymer compositions are described in e.g. EP 02 029 663, EP 06 011 267 or EP 06 011 269, which are incorporated as reference.

In the present invention, it is preferred that flame retardant sheath layer comprises a polymer composition, which comprises e) a polymeric base resin (D), f) a silicone-group containing compound (E), and g) an inorganic component (F).

Suitable polymers for forming polymeric base resin (D) include polyolefins, polyesters, polyethers and polyurethanes, as described above.

Furthermore, it is preferred that the sheath layer comprises a silicone-group containing compound (E). Compound (E) preferably is a silicon fluid or a gum, or a copolymer of ethylene and at least one other co-monomer including a vinyl unsaturated polybishydrocarbylsiloxane, or a mixture of these compounds as described e.g. in EP 02 019 663.

Compound (E) is preferably used in an amount of 0 to 70 wt %, more preferably 1 to 10 wt %, and still more preferably 1 to 5 wt %, based of total polymer composition of the sheath layer.

Suitable compound for the inorganic component (F) comprises all filler materials as known in the art which are neither a hydroxide nor a substantially hydrated compound. Component (F) may also comprises a mixture of any such filler.

In a preferred embodiment of the present invention, component (F) is an inorganic carbonate, more preferred a carbonate of metal of group II of the Periodic system of the Elements, aluminium and/or zinc, and still more preferred is calcium carbonate or magnesium carbonate. Also preferred is a mixture of any preferred materials mentioned. Furthermore, also polynary compounds, such as e.g. huntite ($Mg_3Ca(CO_3)_4$).

In the present invention it is preferred that the flame retardant sheath layer comprises 20 wt % or more of component (F).

It is also preferred that the polymer composition of the sheath layer comprises further additive known in the art. Such additives are used in an amount up to 10 wt %, based on the total polymer composition of the sheath layer.

In the present invention, the flame retardancy of the cable is determined according to the European Fire class of cables, also called European project "FIPEC". The cable is tested in "real life" scenarios. There are two distinct scenario, one vertical and one horizontal scenario. A description of these test scenarios can be found in "Fire performance of electric Cables—New test methods and measurement techniques", final report of the *European Commmision* (SMT4-CT96-2059), ISBN 0953231259.

The cables are classified in different classes, which are:

Class A: Class A relates to the criteria for class A1 for linings.

Class B: Class B characterizes all products that show a non-continuing flame spread in neither the horizontal reference scenario nor the vertical reference scenario for any ignition sources 40-100-300 kW. They should also show limited heat release rate (HRR). This applies also for the 30 kW test exposure in $FIPEC_{20}$ Scenario 2.

Class C: Class C characterizes all products that show a non-continuing flame spread when exposed to 40 to 100 KW ignition source in the horizontal reference scenario and a non-continuing flame spread, a limited fire growth rate (FIGRA), and limited HRR when exposed to the 20 kW test procedure, $FIPEC_{20}$ Scenario 1.

Class D: Class D characterizes all products that show a fire performance better than ordinary not flame retardant treated polyethylene and a performance approximately like wood when tested in the reference scenarios. When tested in $FIPEC_{20}$ Scenario 1 the products show a continuous flame spread, a moderate FIGRA, and a moderate HRR.

Class E: Class E characterizes all products that show a non-continuous flame spread when a single cable is vertically exposed to a 1 kW ignition source. The small flame test already proposed by industry is used (EN 60332-1-2).

In the present invention, it is preferred that the cable fulfils the requirements of at least class D.

The cable of the present invention preferably has a fire growth rate (FIGRA) index equal to or less than 2000 w/s, more preferably of less than 1500 w/s, most preferably of less than 1000 w/s, measured according to $FIPEC_{20}$ Scenario 1.

The heat release rate (HRR) preferably is of equal to or less than 620 kW, more preferably of less than 550 kW, most preferably less than 500 kW, measured according to $FIPEC_{20}$, Scenario 1.

It is also preferred that the total heat release ($THR_{1200s}$) is equal to or less than 86 MJ, more preferred less than 80 MJ, most preferred less than 75 MJ, measured according to FIPEC20, Scenario 1.

The cables of the present invention may be produced by any method known in the art. Most commonly the insulated conductors are produced separately as they need to be twisted (in general the cables consist of many—most commonly 3 insulated conductors, wherein the insulation layers have different colours). The insulated conductors are twisted together in a separate production step. The twisted parts are then coated by an extruded bedding layer, which commonly directly is coated with the extruded sheath. It might be also happen that this is done in two step, probably due to that the producer is lacking modern equipment. In order to avoid the bedding to stick to its surrounding layers talcum is often "powdered" onto the insulated conductors and bedding layers just before the bedding and sheathing extrusion step.

The cable of the present invention preferably is a low voltage cable, used as e.g. control or a telecommunication cable.

METHOD AND EXAMPLES

1. Determination of LOI (Limited Oxygen Index)

LOI was determined using a Ceast Flammability Unit by US standard ASTM D 2863-9 and the ISO 4589-2. The LOI results are based on approximately 3 test specimens of dimension "150×6 mm". These are stamped out from a 3 ram thick plate pressed in a Collins press (low pressure (20 bar) at 10° C. during one minute followed by high pressure (300 bar) during five minutes at the same temperature). Cooling rate was 10° C./minute under high pressure.

LOI is measure of the minimum oxygen concentration of an $O_2/N_2$ mixture required to sustain combustion for a minimum of 3 minutes or not propagate more than 5 cm from the top of test specimen. LOT is a measure of ease of extinction.

2. $FIPEC_{20}$ Scenario 1

The cables were tested according to prEN 50399-2-1 ($FIPEC_{20}$ Scenario 1) test specifications. The cable mounting was determined by the overall cable diameter and exposed to the 20 kW burner for 20 minutes as specified.

3. Compounding Composition

The bedding compositions according to the invention and for comparative purpose were produced by mixing together the components in a Banbury kneader (375 $dm^3$). Materials were processed until a homogenous melt was accomplished and then mixed for another 2 minutes. The still hot materials were taken from the Banbury mixer onto a two-roll mill to produce a slab, from which plaques for testing were prepared.

4. Production of Cables 0.7±0.1 mm insulation layer was extruded onto 1.5 $mm^2$ copper conductor on a Francis Shaw 60 mm/24D wire line. Three cores were twisted together by the use o a Northampton Twister. The bedding (Extruder: Maillefer 45 mm/30D) and sheathed (Extruder Mapre 60 mm/24D) layers were applied by a tandem extrusion process. In order to avoid adhesion between the bedding and its surrounding layers talcum were "powdered" onto the cores and bedding layer just prior the bedding and sheath layer were applied.

5. Polymer

The resins (A) used as examples of the invention are in more detail explained table 1 and it footnotes.

As inorganic filler (B) aluminiumtrihydroxide (ATH) was used.

As inorganic compound (C) calcium carbonate was used.

As insulation and sheathing layer commercial compounds intended for wire & cable applications and all produced by Borealis Technology Oy were used.

FR4820 is a flame retardant insulation based on Borealis Casico technology consisting of a combination of polyolfin, calcium carbonate and silicon elastomer, and has a Melt flow rate at a weight of 2.16 kg and 190° ($MFR_{2.16,\ 190°\ C.}$) of 0.9 g/10 min and a density of 1150 $kg/m^3$ FR4804 is a flame retardant sheath based on the Casico technology $MFR_{2.16,\ 190°\ C.}$=0.4 g/10 min, density=1150 $kg/m^3$. The used bedding compositions (inventive and comparative) and the LOI values of such compositions are shown in Table 1.

TABLE 1

Bedding Composition and LOI results

| Bedding composition Weight-% | BC1 (inventive) | BC2 (inventive) | BC3 (inventive) | LK1835/19 (comparative) | FM1249 (comparative) |
|---|---|---|---|---|---|
| EVA-1[1] (resin A) | 3.0 | | | | |
| EVA-2[2] (resin A) | 4.0 | | | | |
| EBA[3] (resin A) | | 13.6 | | | |
| EMA[4] (resin A) | | | 13.6 | | |
| NBR[5] (resin A) | | 3.4 | 3.4 | | |
| TPE-E[6] (TPEE) | 3.0 | | | | |
| Plasticizer[7] | 7.0 | | | | |
| Process aid[8] | 1.3 | 1.5 | 1.5 | | |
| Halogenfree organic fraction[9] | | | | 16.6 | 18.7 |
| $CaCO_3$[10] $_{type1\ MX30}$ | 55 | | | 83.4 | 81.3 |
| $CaCO_3$[11] $_{type2,\ microsöhl}$ | | 32.1 | 32.1 | | |
| ATH[12] | 26.8 | 49.4 | 49.4 | 0 | 0 |
| LOI | 37 | 62 | 64 | 26 | 26 |

[1]Etylene-vinylacetate-copolymer containing 28 w-% vinylacetate, $MFR_{2.16,\ 190°\ C.}$ = 7 g/10 min
[2]Etylene-vinylacetate-copolymer containing 26 w-% vinylacetate, $MFR_{2.16,\ 190°\ C.}$ = 2 g/10 min
[3]Etylene-butyl-acrylate copolymer containing 35 w-% butylacrylate, $MFR_{2.16,\ 190°\ C.}$ = 40 g/10 min
[4]Etylene-metylacrylate (EMA) copolymer containing 20 w-% methylacrylate, $MFR_{2.16,\ 190°\ C.}$ = 20 g/10 min
[5]Nitril-butadiene-rubber, Mooney viscosity ML (1 + 4) 100° C. = 40, nitrile content 35 w-%
[6]Thermoplastic ether ester polymer with a hardness, shore D of 36, $MFR_{2.16,\ 200°\ C.}$ = 12 g/10 min
[7]blend of paraffinic and poly-isobutylene oils
[8]fatty acids waxes
[9]Halogenfree organic fraction: LK1835/19 and FM1249 are commercial beddings produced by Melos AG.
[10]$CaCO_{3\ type1}$ = Average particle size 3.0 um (0-23 um), $CaCO_3$ content 99.5 w-% ($MgCO_3$ 0.3 w-%, $Fe_2O_3$ 0.05%, HCl insoluble 0.3 w-%).
[11]$CaCO_{type2,\ microsöhl}$ = Average particle size 2.3 um (0-10 um), $CaCO_3$ content 88 w-% ($MgCO_3$ 1 w-%, $Fe_2O_3$ 0.5%, HCl insoluble 10 w-%).
[12]ATH = Average particle size 12.5 um (0-40 um), $Al(OH)_3$ content 99.6 w-%.
All inventive examples has a LOI of at least 37, which is well above the LOI of the comparative examples.

The flame retardancy of the cables are shown in Table 2. The tested cables comprise either the inventive or a comparative bedding composition according to Table 1. Furthermore all bedding compositions comprise calcium carbonate as inorganic compound (C).

TABLE 2

HRR overview - 0.5 mm Insulation

| Examples | Sheath | ATH/$CaCO_3$ [%/%] | Bedding | Insulation | Number of Cables | FIGRA [W/s] | $THR_{1200S}$ [MJ] | $Peak_{HRRsm30}$ [kW] |
|---|---|---|---|---|---|---|---|---|
| Comp. Ex 1 | FR4804 | Only $CaCO_3$ | LK1835/19 | FR4820 | 19 | 2900 | 86 | 708 |
| Comp. Ex. 2 | FR4804 | Only $CaCO_3$ | FM1249 | FR4820 | 19 | 2867 | 87 | 709 |
| Example 1 | FR4804 | 0.49 | BC1 | FR4820 | 19 | 1578 | 74 | 447 |
| Example 2 | FR4804 | 1.54 | BC2 | FR4820 | 19 | 1223 | 83 | 455 |
| Example 3 | FR4804 | 1.54 | BC3 | FR4820 | 19 | 1413 | 80 | 494 |

The cables based on the inventive beddings shows much slower flame propagation as indicated by lower FIGRA and PEAK $HRR_{srn30}$. The FIGRA value is $THR_{1200s}$ divided the time until the peak of heat release is reached. The lower FIGRA value the lower is the heat release peak and the longer until it's reached. The inventive examples have better $THR_{1200s}$ values than the comparative examples. The Difference is clear but not substantial. All examples have similar content of fillers and should accordingly have similar $THR_{1200s}$. Dispite this have the inventive examples lower $THR_{1200s}$. The $PeakHRR_{srn30}$ values show a clearly lower heat release peak than the comparative examples. This means that the fire is less violent.

The invention claimed is:

1. A cable comprising one or more insulated conductors which are embedded in a bedding composition, which comprises a) a polymeric base resin (A), wherein all organic polymeric components of the bedding composition are comprised in the base resin, and wherein the amount of the polymeric base resin (A) is not more than 20 wt % of the bedding composition;

b) an inorganic filler (B), wherein the inorganic filler (B) is aluminum trihydroxide (ATH); and c) an inorganic compound (C) which is neither a hydroxide or hydrated compound;

wherein the ratio of inorganic filler (B) to inorganic compound (C) is 0.4 to 2.

2. The cable according to claim 1, wherein the amount of inorganic filler (B) is from 10 to 90 wt %, based on the total bedding composition.

3. The cable according to claim 1, wherein the amount of the polymeric base resin (A) is from 5 to 20 wt % of the bedding composition.

4. The cable according to claim 1, wherein the total amount of inorganic filler (B) and inorganic compound (C) is from 40 to 90 wt %, based on the total bedding composition.

5. The cable according to claim 1, wherein polymeric base resin (A) is formed by a rubber, wax, oil, stearate, olefins, polyolefines, thermoplastic elastomers and or combinations thereof.

6. The cable according to claim 1, wherein the limited oxygen index (LOI) of the bedding composition is at least 25.

7. The cable according to claim 1, wherein the cable further comprises a flame retardant sheath layer.

8. The cable according to claim 7, wherein the flame retardant sheath layer comprises a polymer composition, which comprises e) a polymer base resin (D);

f) a silicone-group containing compound (E); and g) an inorganic component (F).

9. The cable according to claim 1, wherein the cable has a fire growth rate index (FIGRA) of equal to or less than 2000 W/s measured according to FIPEC20 Scenario 1.

10. The cable according to claim 1, wherein the cable has a peak heat release rate (PeakHRRsrn30) of equal to or less than 620 kW measured according to FIPEC20 Scenario 1.

11. The cable according to claim 1, wherein the cable has a total heat release (THR 1200) of equal to or less than 86 measured according to FIPEC20 Scenario 1.

12. The cable according to claim 1, wherein the cable is a low voltage cable.

* * * * *